US006126159A

United States Patent [19]

Dornfeld

[11] Patent Number: 6,126,159

[45] Date of Patent: Oct. 3, 2000

[54] MACHINABLE WORKPIECE CLAMP

[76] Inventor: Stanley W. Dornfeld, 17472 Plz. Abierto, #9, Rancho Bernardo, Calif. 92128

[21] Appl. No.: 09/371,735

[22] Filed: Aug. 10, 1999

[51] Int. Cl.[7] ..... B25B 1/00

[52] U.S. Cl. ..... 269/138; 269/153; 269/234; 269/259 R; 269/43

[58] Field of Search ..... 269/91–94, 99–101, 269/138, 234, 152, 153, 254 R, 43, 906

[56] References Cited

U.S. PATENT DOCUMENTS 4,804,171 2/1989 Dornfeld .

5,735,513 10/1999 Toffolon ..... 269/138

5,961,108 10/1999 Weber ..... 269/138

*Primary Examiner*—Robert C. Watson

*Attorney, Agent, or Firm*—Henri J. A. Charmasson; John D. Buchaca

[57] ABSTRACT

A holding device which wedges against the side of a workpiece to provide unencumbered access during machining operations. The jaws of the device are thick enough to be contoured to the shape of the workpiece for a firmer hold. A clamping brace is provided to immobilize the jaws during their machining.

7 Claims, 1 Drawing Sheet

FIG. 1
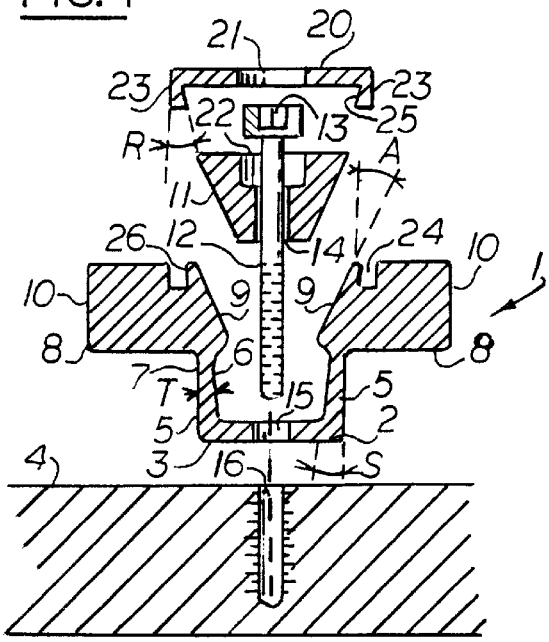
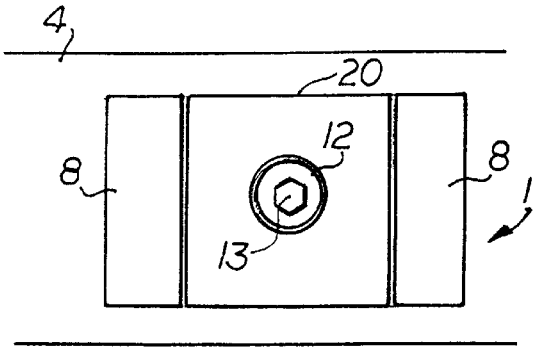
FIG. 2
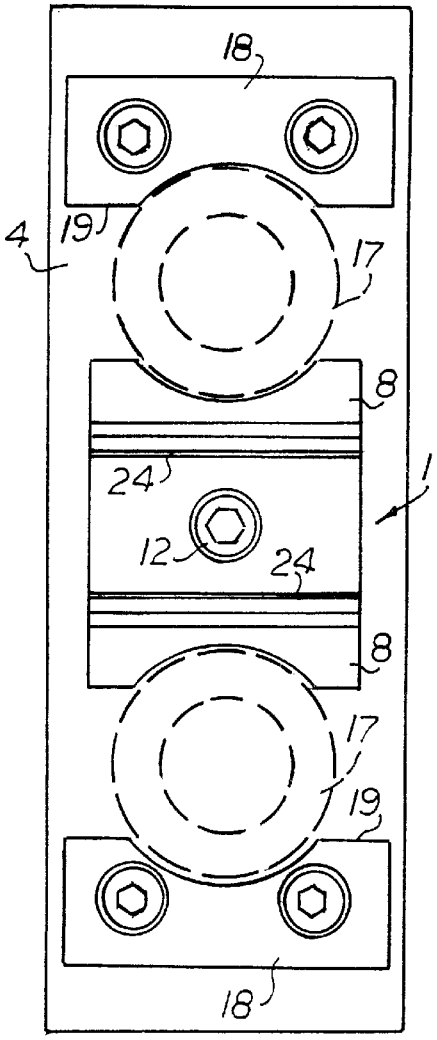
FIG. 3

MACHINABLE WORKPIECE CLAMP

FIELD OF THE INVENTION

This invention relates to adjustable workpiece clamps and other holding devices, and more specifically to metal devices for securing a workpiece on the bed of a machine tool.

BACKGROUND OF THE INVENTION

The instant invention is an improvement and addition to the workpiece holding device disclosed and claimed in my patent No. 4,804,171 issued Feb. 14, 1989 which patent is incorporated in this specification by this reference.

The aforesaid workpiece holding device was characterized by flat, vertical jaw surfaces which, on occasion, had to be reshaped to conform to the outline of a particular workpiece in order to provide a firmer and more stable hold. However, due to the inherent flexible nature of the clamping jaws, they had a tendency to vibrate as they were machined even though the spreading wedge was tightened to the end of its course.

The present invention results from an attempt to stabilize the entire workpiece holding device during the machining of its clamping jaws.

SUMMARY OF THE INVENTION

The principal and secondary objects of this invention are to provide a way to immobilize the clamping jaw surfaces of my workpiece holding device during reconfiguration of their jaw surfaces through machining in order to conform with the shape of the workpiece to be clamped; and to do so without affecting the characteristics and operation of the device, all by means of a quick, simple and economical implement.

These and other objects are achieved by using a capping brace which has downwardly extending flanges at each end, which flanges can be captured by grooves in the tops of the clamping jaws, whereby with the brace in place, the clamping jaws can be spread by turning the head of the clamping screw through an opening in the brace, thus firmly securing the flanges within the grooves.

BRIEF DESCRIPTION OF THE DRAWING

FIG. 1 is a cross-sectional, exploded view of the machinable workpiece clamp and its immobilizing brace;

FIG. 2 is a top plan view thereof; and

FIG. 3 is a top plan view of a machined clamp holding a pair of workpieces.

DESCRIPTION OF THE PREFERRED EMBODIMENT OF THE INVENTION

Referring now to the drawing, there is shown a clamp 1 made from rigid material having some resilient flexibility, preferably steel. The clamp comprises a base 2 having a flat, horizontal undersurface 3 for mounting upon a tooling structure 4. Projecting upwardly from opposite ends of the base, are two substantially parallel shanks 5 which have a median thickness T of approximately 1 millimeter (0.04 inch), being slightly thicker at their lower end than their upper end due to their inner face 6 slant S of approximately 10 degrees in relation to their vertical outer face 7. The shanks support a pair of heads 8. Each head has an inner side 9, facing the inner side of the opposite head, that tapers upwardly and outwardly away from it at an angle A of approximately 45 degrees from the vertical. The external side 10 of each head is provided with extra material that can be machined to a jaw surface which conforms to the shape of a workpiece as will be further explained in connection with FIG. 3. A wedge-shaped block 11 is dimensioned to intimately nest between the internal sides 9 of the heads. A screw 12 having a head with a Allen-type driving cavity 13 passes through vertical holes 14 and 15 bored through the center of the block and base respectively, engages a threaded hole 16 in the tooling structure 4. When the screw is tightened, the block 11 is forced down against the internal sides 9 of the heads spreading the heads outwardly in a generally horizontal direction away from each other.

As more specifically illustrated in FIG. 3, the external sides 10 of the jaws have been machined to conform with the contour of a pair of circular workpieces 17 shown in dotted lines. Barrier blocks 18 with similarly machined faces 19 are bolted to the tooling structure 4 astride each workpiece from the clamp 1. The contouring of the clamping external sides 10 of the head provides for a firmer and more stable holding of the workpieces above the tooling structure.

In order to stabilize the heads 8 of the clamp during the machining of the clamping external faces 10, there is provided a brace 20 consisting essentially of a plate dimensioned to bridge or span the two heads 8. The brace has a central hole large enough to provide driving access to the cavity 13 in the head of the screw 12 nesting in the enlarged upper portion 22 of the block center hole. Two flanged projections 23 extending downwardly from opposite ends of the brace 20 are shaped and dimensioned to conveniently engage into parallel grooves 24 cut into the upper surface of the clamped heads. The inner walls 25 of the flanged projections and the inner walls 26 of the grooves are slanted at an angle R ranging approximately from 5 to 20 degrees from the vertical in a dove-tail cross-sectional configuration in order to vertically lock the brace over the clamp and prevent the flanged projections from popping out of the grooves when the jaws are immobilized by tightening of the screw 12. It can now be understood that once the brace-equipped clamp is tightly secured on top of the tooling structure, the external sides of the clamping jaws can be conveniently machined without the clamp being subject to any vibrations.

While the preferred embodiment of the invention has been described, modifications can be made and other embodiments may be devised without departing from the spirit of the invention and the scope of the appended claims.

What is claimed is:

1. A clamping device for immobilizing a workpiece over a support structure, said device comprising:

a base having a vertical hole bored in a median section thereof;

a pair of vertical jaw members integrally formed with said base and extending at spaced-apart locations and in substantially parallel vertical directions;

each of said jaw members having a narrow flexible shank rising from said base, and a head extending from said shank;

said head having an oblique internal side, a machinable external side and a top surface;

said oblique internal side facing a similar internal side on the head of the other jaw member, and tapering upwardly and outwardly therefrom;

a solid block shaped and dimensioned to nest between and against the oblique internal sides of said heads, said block having a vertical hole bored in a median section thereof;

a screw passing through said holes in said block and base for engagement with a threaded hole in said supporting structure, said screw having a head retained by said block;

whereby progressive engagement of said screw into said threaded hole causes the block to slide down said oblique sides, resiliently forcing said jaw members away from one another; and means for clamping said jaws at a stable distance from one another during machining of said machinable side.

2. The device of claim 1, wherein said means for clamping comprises:

a rigid brace dimensioned to span said heads, and having opposite ends securable to said heads; and means for securing said opposite ends to said heads.

3. The device of claim 2, wherein said means for securing comprises:

said brace having projections extending downwardly from each of said opposite ends; and each of said heads having a cavity shaped and dimensioned for receiving one of said projections.

4. The device of claim 3, wherein said brace further comprises a substantially flat central section having a bore therethrough, said bore being positioned to provide operating access to the head of said screw.

5. The device of claim 4, wherein each of said projections comprises a flange, and each of said cavities consists of a groove at the top surface of one of said heads.

6. The device of claim 5 which further comprises means for holding said projection into said groove.

7. The device of claim 6, wherein said means for holding comprise said projection and said groove having dove-tail cross-sections.

* * * * *